United States Patent [19]

Odell

[11] 4,398,772

[45] Aug. 16, 1983

[54] DRILL PIPE PROTECTOR

[75] Inventor: Richard Odell, Houston, Tex.

[73] Assignee: The Mead Corporation, Dayton, Ohio

[21] Appl. No.: 300,863

[22] Filed: Sep. 10, 1981

[51] Int. Cl.[3] ..... F16C 17/00

[52] U.S. Cl. ..... 308/4 A; 138/110; 138/96 R

[58] Field of Search ..... 308/4 A; 138/110, 96 R; 166/241; 175/325

[56] References Cited

U.S. PATENT DOCUMENTS

| | | | |
|---|---|---|---|
| 1,913,018 | 6/1933 | Berryman | 308/4 A |
| 2,657,956 | 11/1953 | Hall | 308/4 A |
| 2,959,453 | 11/1960 | Jacobs | 308/4 A |
| 3,103,391 | 9/1963 | Leathers | 308/4 A |
| 3,197,262 | 7/1965 | Fairchild | 308/4 A |
| 3,227,498 | 1/1966 | Leathers | 308/4 A |
| 3,320,004 | 5/1967 | Garrett | 308/4 A |
| 3,397,017 | 8/1968 | Grant et al. | 308/4 A |
| 3,410,613 | 11/1968 | Kuus | 308/4 A |
| 3,414,337 | 12/1968 | Sable | 308/4 A |
| 3,528,499 | 9/1970 | Collett | 166/175 |
| 3,894,779 | 7/1975 | Hoon et al. | 308/4 A |
| 3,894,780 | 7/1975 | Broussard | 308/4 A |
| 4,011,918 | 3/1977 | Jurgens | 175/325 |
| 4,105,262 | 8/1978 | Richey | 308/4 A |
| 4,266,578 | 5/1981 | Swain et al. | 138/110 |

FOREIGN PATENT DOCUMENTS

| | | | |
|---|---|---|---|
| 499505 | 1/1954 | Canada | 308/4 A |

*Primary Examiner*—John W. Shepperd

*Attorney, Agent, or Firm*—Biebel, French & Nauman

[57] ABSTRACT

A drill pipe protector is disclosed which provides a fluid-tight hydraulic seal between the protector and the drill pipe. The protector comprises a cylindrical body of an elastomer which is longitudinally split and encases a cylindrical and similarly split metal band. A sealing bead is formed along the periphery of the inside surface of the elastomeric body and along the longitudinal split therein. Under compression the sealing bead prevents fluids from entering between the drill pipe and the protector. In a preferred embodiment the metal band is concave and is adapted to receive a tapered locking pin which adjustably latches the protector into optimum frictional engagement with the drill pipe.

12 Claims, 6 Drawing Figures

DRILL PIPE PROTECTOR

BACKGROUND OF THE INVENTION

The present invention relates to so called drill pipe protectors and, particularly, to a protector which is designed to provide a fluid tight hydraulic seal between the drill pipe and the protector.

Drill pipe protectors are well known. Generally they are formed of an elongated annular body of an elastomer which encases a metal band as a backing element. Drill pipe protectors are used in combination mounted at spaced locations on the drill pipe where they function as a bushing to prevent the drill pipe from colliding with the well bore or casing. First, there is a tendency for the protectors to slip on the drill pipe. They are sized such that the fluids used during the drilling operation can pass up along the protector and out of the well. In many cases a plurality of longitudinal flutes which extend radially from the outside surface of the protector body and provide wear-resistant, contact surfaces between the drill pipe and the well are formed on the protector and channel the drilling fluids around the protector. Some drill pipe protectors are fixed to the drill string and are adapted to rotate with the drill pipe during the drilling operation whereas others are non-rotating protectors and float on the drill pipe. The present invention is directed to the former non-floating protector.

There are numerous examples of drill pipe protectors in the prior art some of which are shown in U.S. Pat. Nos. 2,959,453; 3,103,391; 3,197,262; 3,227,498; 3,320,004; 3,410,613; 3,414,337; 3,894,780; 4,011,918; 4,105,262; and 4,266,578. U.S. Pat. No. 4,266,578 illustrates a protector having many of the features found in prior protectors viz. a fluted, elongated, elastomeric body encasing a metal reinforcing band formed by two semi-cylindrical halves hinged at one side and locked with a tapered pin at the other, wherein the elastomeric body is a composite of an abrasion resistant rubber on the well wall engaging face and a low compression rubber interfacing the drill pipe.

While prior drill pipe protectors have been effective there have been some drawbacks with their use. Due to this slippage, often the protectors are found accumulated on one portion of drill strip, e.g., accumulated above a tool joint, after the drilling operation.

In addition to slippage, another disadvantage of prior drill pipe protectors which is associated with slippage is that the drilling mud seeps between the drill pipe and the protector leading to some corrosion of the pipe.

Thus, there is a need for a drill pipe protector with improved engagement with the drill pipe.

SUMMARY OF THE INVENTION

The present invention has as its object providing a drill pipe protector which provides a fluid-tight hydraulic seal between the protector and the drill pipe which prevents drilling fluids from entering between them and prevents the protector from slipping and migrating down the drill string.

A further object of the invention is to provide a drill pipe protector which rotates smoothly on the drill pipe within the well and resists chunking.

The drill pipe protector of the present invention is designed to provide a fluid tight hydraulic seal between the protector and the drill pipe which prevents the protector from slipping down to the tool joint. This is accomplished using a sealing bead to provide a fluid tight seal between the drill pipe and the protector and forming the protector with a metal backing band through which the protector tension mounts the drill pipe with hydraulic pressure. The sealing bead is formed along the peripheries of the inside cylindrical surface of the protector and along each side of the longitudinal split therethrough. When the protector is tension mounted on the drill pipe, the sealing bead is compressed against the drill pipe and thus prevents fluids from entering between the inside surface of the protector and the drill pipe. The metal band encased in the protector divides the protector into an inner volume of elastomer which faces the drill pipe and an outer volume which constitutes the balance of the elastomer body. These volumes may be formed from different elastomers which are selected to provide the properties desired in each volume. When the protector is mounted on the drill pipe the band is tensioned and the inner volume of elastomer is compressed by the band. This causes the inner plume of elastomer to exhibit fluid-like properties, enabling it to assume the contour of the drill pipe and provide what is referred to herein as a "hydraulic seal" between the drill pipe and protector.

The band may be formed of one cylindrical metal sheet or a pair of longitudinally hinged semi-cylindrical halves which pivot about a hinge pin. The band is preferably adapted to receive a tapered locking pin. The tapered pin adjustably latches the protector into compressive engagement with the drill pipe and locks into the metal band the tension necessary to achieve a fluid tight hydraulic seal.

In a further embodiment of the invention, the metal band is formed with a concavity which extends along its longitudinal axis and opens radially inward to capture the inner volume of elastomer and thereby concentrate the compressive force on that volume.

The drill pipe protector of the present invention may be formed with or without a plurality of longitudinally extending flutes. When flutes are present, there are preferably at least five. In a preferred embodiment of the invention the edges of the flutes are radiused to smoothen the flow of the drilling fluids past the protector and to prevent so called chunking or tearing away of chunks of the flutes when the protector collides with the wall of the well during the drilling operation.

DETAILED DESCRIPTION OF THE INVENTION

Figure 1:
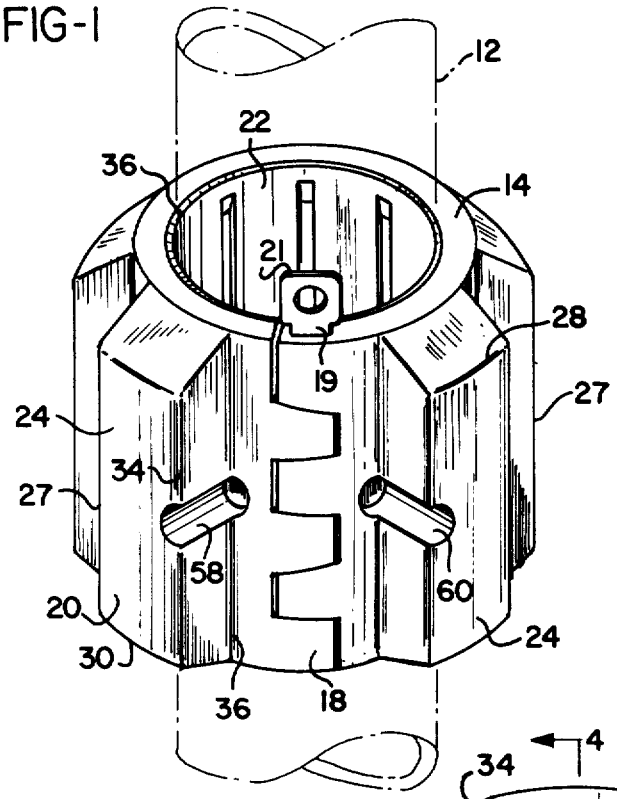
FIG. 1 is a isometric view from the front split of one embodiment of drill pipe protector of the present invention.

The drill pipe protector of the present invention is illustrated in FIG. 1 where it is generally indicated by the numeral 10 and shown mounted for rotation on a drill pipe 12 which is shown in broken line. The drill pipe protector of the present invention comprises a cylindrical body of an elastomer 14 which encases or encapsulates a metal band 16 (FIGS. 2 and 3) which divides the protector body 14 into an inner volume 15 and an outer volume 17. The elastomeric body 14 and band 16 of the protector are longitudinally split. In FIG. 1 this split is formed by a plurality of interweaving fingers 18 which engage one another when the protector is tension mounted on the drill pipe. The protector 10 is resilient enough to be able to open at the split and admit the drill pipe. To mount the protector on the drill pipe 12 tension is applied to the metal band 16 to force close it on the pipe and compress the inner volume 15 of elastomer. In this regard the inner volume of elastomer 15 is a compression volume and is preferably formed of a soft, pliable elastomer which will cold flow and assume the contour of the drill pipe under the pressure of the band. The protector is held in compression on the drill pipe by locking pin 21 which is preferably tapered to wedge lock the opposing sides of the protector around the pipe. The inner diameter of the drill pipe protector is essentially equal to the outer diameter of the drill pipe which is usually manufactured in 3.5, 4.5 and 5 inch diameters. As already indicated, the drill pipe protector of the present invention is the type which rotates with the drill pipe in the well and accordingly mounts the drill pipe with a fluid tight immovable engagement.

Fingers 18 are formed of connecting means 44 (FIG. 3) encased in elastomer to provide openings 19 for locking pin 21. Where the locking pin is tapered the openings 19 cooperatively form a channel having a taper matching that of the pin. The outer volume 17 of the drill pipe protector is designed to function as a bushing which prevents the drill pipe from colliding with the well bore or casing should it laterally whip during the drilling operation. The outside diameter of the protector is selected such that the protector is downwardly received in the well bore or well casing without interference and such that the protector does not bind in the well during drilling. Generally, the outside diameter of the drill pipe protector is greater than the diameter of the tool joint and slightly less than the inside diameter of the well bore or casing. Similarly, the protector must be designed to permit drilling fluids to pass up the well and along the protector in the course of the drilling operation. Where the drill pipe protector is the smooth-type, the outer diameter must permit this passage. Where the drill type protector is fluted, the fluids are channeled past the protector by the flutes.

In one embodiment the annular body 14 is desirably formed of an abrasion and wear-resistant elastomer or rubber composition which will also conform to the surface of the drill pipe. Various rubber compositions are commercially available which have been used for this purpose. Natural rubber, styrene-butadiene rubber, polyisoprene rubber and blends thereof are suitable. In preferred compositions, the elastomer is compounded with an extender oil and reinforced, for example, with carbon blacks to enhance its service life. In a preferred embodiment, the elastomeric body 14 is formed of a rubber composite in which the inner volume abutting the drill pipe is formed of a softer, pliable elastomer which provides the optimum degree of frictional engagement with the drill pipe and the outer volume facing the well walls is a more abrasion resistant material.

Figure 2:
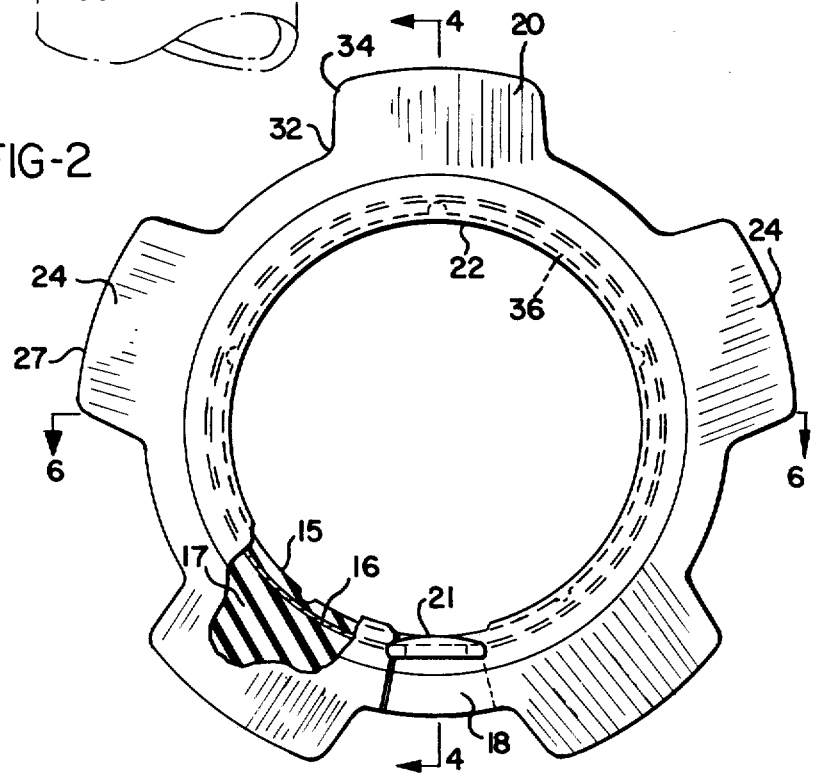
FIG. 2 is a top view and partial cut away section of the drill pipe protector of FIG. 1.

The drill pipe protector has an outer face 20 and an inner face 22 which interfaces the drill pipe 12 as best seen in FIG. 2. FIGS. 1 and 2 illustrate the embodiment of the invention in which a plurality of longitudinally extending flutes 24 are circumferentially spaced along the outer face 20 of the protector. Flutes 24 are radial extensions of the elastomeric body 14 and enhance the circulation of the drilling fluids and the ability of the fluids to entrain drill cuttings. They also provide contact surfaces 27 with the internal wall of the well such that the drill pipe is protected from wear.

The flutes divide the outer face 20 of the protector into a series of channels between and protective surfaces 27. The flutes are desirably designed to provide smooth, enhanced, non-interfering flow of the drilling fluids past the protector and to minimize or prevent chunking of the flutes when they collide with the well bore or casing. To this end, the flutes are preferably radiused at their upper and lower longitudinal extremities 28 and 30 and are radiused along their sides 32 and 34. Drilling fluids pass up the well and past the protector through channels. Protective surfaces 27 prevent the drill pipe from colliding with the wall of the well by engaging the well wall when the drill pipe moves off center. The flutes are of a sufficient width to provide the necessary buffering or bushing action. While the number of flutes may vary, it has been found that protectors formed with five or more flutes give a smoother transition from one flute to the next when the drill pipe contacts the well wall than do protectors having four or fewer flutes. This reduces vibration of the drill pipe and the likelihood that chunks of rubber will be torn from the protector as the protector rotates with the drill string.

Figure 4:
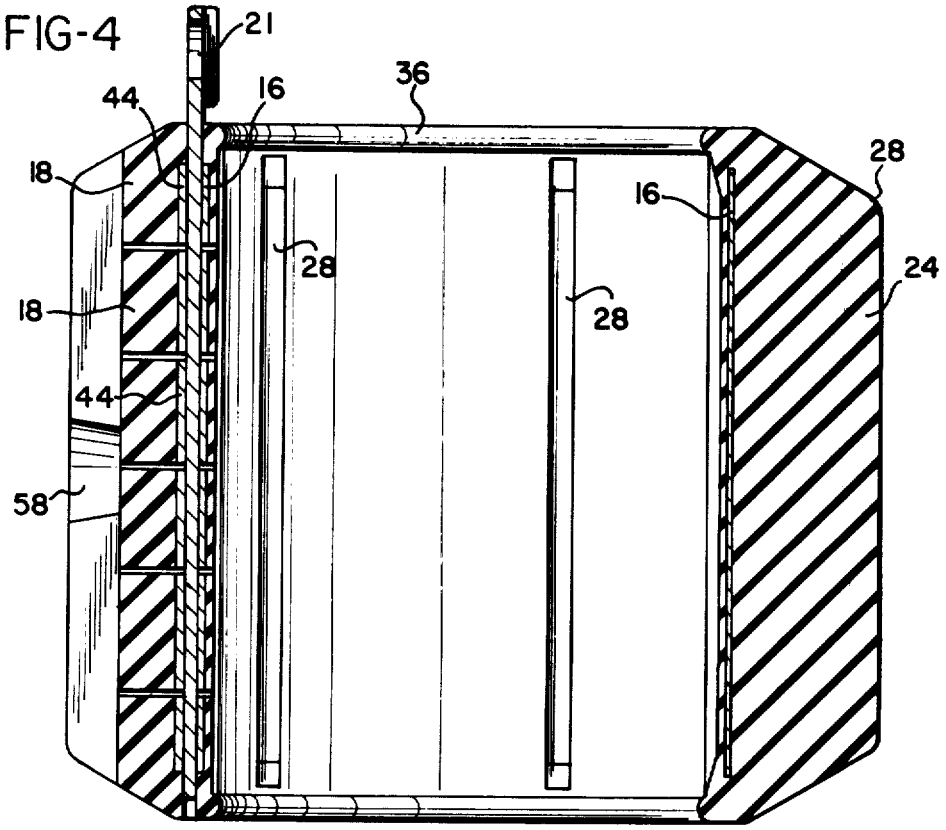
FIG. 4 is a section along the line 4—4 in FIG. 2.
Figure 6:
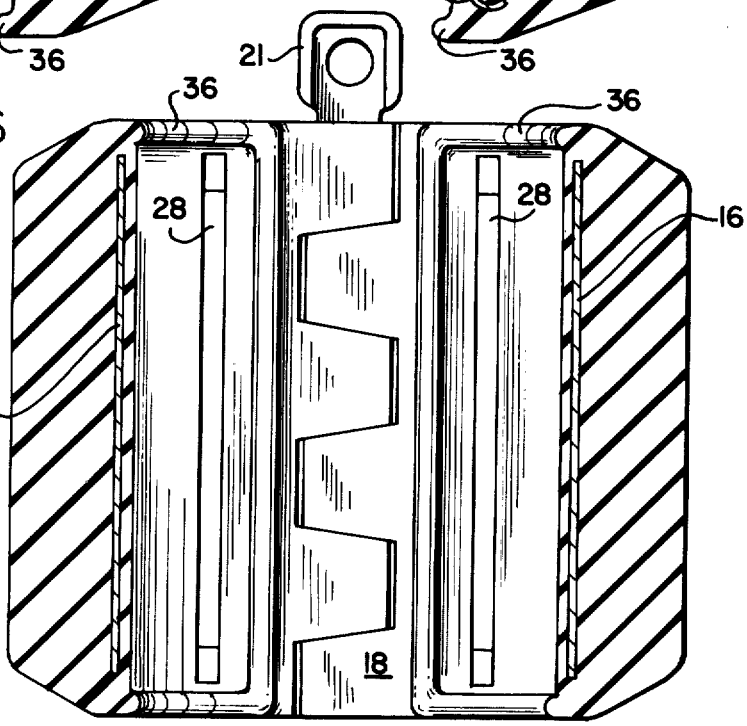
FIG. 6 is a section along the line 6—6 in FIG. 2.

Turning to FIGS. 2 and 4, the inner face of the protector is peripherally bounded by a continuous sealing bead 36 which travels the circumference of the drill pipe at its upper and lower ends and also extends the length of both sides of the longitudinal split as seen in FIG. 6. Under compression sealing bead 36 prevents fluids from flowing between the inner face 22 and the drill pipe 12 and thereby improves the frictional engagement of the drill pipe protector on the drill pipe and prevents the protectors from migrating on the drill pipe and accumulating at one location (e. g., at a tool joint during the drilling operation.

The inner face 22 of the drill pipe protector presents a plurality of grooves 28. Grooves 28 occur in the protector as a result of the manufacturing process wherein spacers are used to fix the position of the metal band in the mold and prevent it from being displaced inward during molding. Without using spacers, the band would be carried to the inside surface of the protector as the elastomer is injected in the molding process. Grooves 28 also provide relief areas which function to equalize the distribution of clamping forces on the surface of the drill pipe. The grooves 28 should not break the sealing bead 36 and should be located entirely inside its perimeter.

Figure 3:
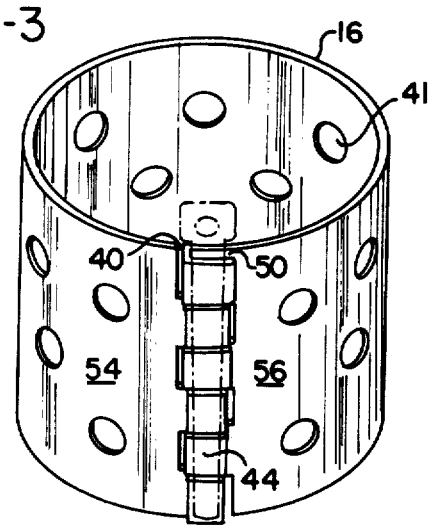
FIG. 3 is a perspective view of a metal insert with connector means in accordance with the invention.

Metal band 16 functions as a backing member to add rigidity to the protector and to provide the tensile strength required to prevent the protector from yielding to drilling stresses. The band configuration is shown in FIG. 3 is for use with a tapered locking pin. The band configuration parallels that of the elastomeric body. The band is generally cylindrical and contains a dovetailed longitudinal split 40 but may be formed of two semi-cylindrical halves hinged at the back when desirable. The longitudinal length of the band is slightly less than that of the elastomeric body. The band is positioned in the body such that it is inside the area bounded by the sealing bead and not behind the bead itself where it may crimp the sealing bead and prevent obtaining a fluid tight seal when the band is tightened. The band may be formed from a continuous metal sheet, but it is preferably perforated as shown in FIG. 3. Perforations 41 are present to provide better mechanical bonding between the band and the elastomer such that the band becomes a unitary part of the elastomeric body. The perforations are preferably in rows which are offset so that when tension is applied to the band there is not one portion of the band which is under particularly greater stress than the others. Instead of perforations laterally extending slits may be formed in the band as shown in U.S. Pat. No. 4,266,578.

The diameter of the band is slightly greater than the inner diameter but less than the outer diameter of the body 14. In this manner the band 16 divides the body 14 into an inner volume 15 and an outer volume 17 which constitutes the remainder of the body 14. Band 16 may be in one piece as shown in the drawings or formed from two semi-cylindrical halves hinged at the backside by a pin about which the two halves may pivot open to admit the drill pipe for installation. This design facilitates installation somewhat since the protector is easier to open and place around the drillpipe, however, it introduces an additional longitudinal seam along the inside surface of the protector which makes it more difficult to achieve a fluid-tight seal with the pipe.

The band 16 and the inner volume 15 cooperate to provide hydraulic engagement between the drill pipe and the protector. The opposing sides of split 40 in the band 16 are formed with connecting means which receive the locking pin 21 shown in FIG. 1. Connecting means are conveniently formed by reverse bending the metal at the split 40 such that interweaving fingers 44 are formed, the bends in the fingers cooperatively form a receiving channel 50 for the locking pin 21. Connecting means 44 may be otherwise fashioned, for example, as a series of eyelets, apertures or hooks for receiving the locking pin. In accordance with the preferred embodiment of the invention, connecting means 44 provide a series of cam surfaces which receive a tapered locking pin as shown in FIG. 3. When inserted in the receiving channel 50, the tapered pin 21 wedges opposing sides 54 and 56 of the band 16 together and thereby adjustably latches the protector into frictional engagement with the drill pipe. When a straight edged locking pin is used the channel 50 is rectangular and not tapered.

Figure 5A:
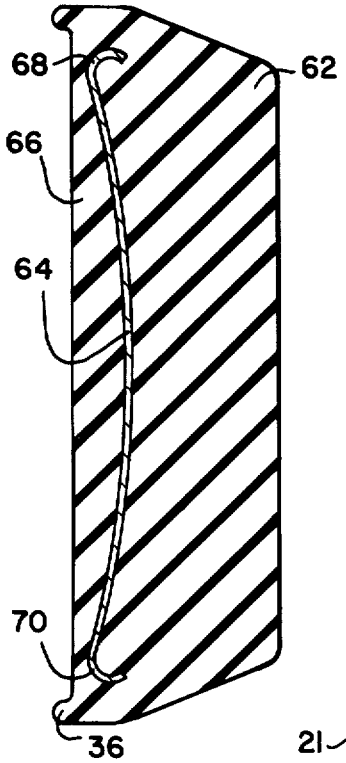
FIG. 5 is a cross-section through one radial segment of the protector showing (a) the metal insert at rest and (b) in clamping position.
Figure 5B:
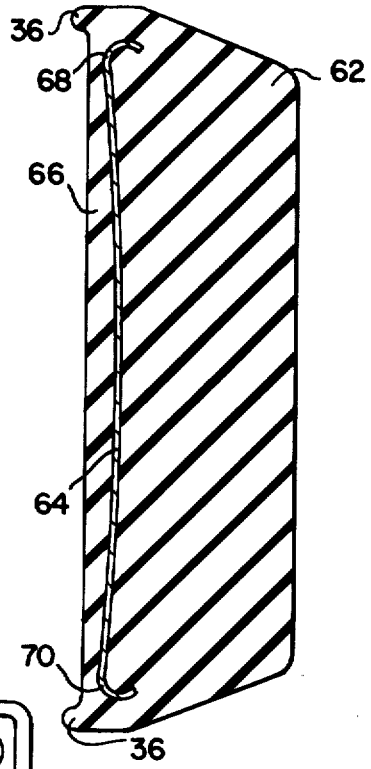

Metal band 16 may be flat, however, it has been found desirable to form the band with an inwardly facing longitudinal concavity which tends to straighten when the band is tension mounted on the drill pipe. FIGS. 5A and 5B are cross sections through one fluted section of an annular drill pipe protector 62 which encases a concave metal band 64. FIG. 5A shows the band in an at rest position such as when it sits on the drill pipe in an untensioned state. The metal band 64 captures a convex inner volume of elastomer 66 between ends 68 and 70 which are slightly curved in the reverse direction to prevent the band from cutting through the elastomeric body when tension is applied. When tension mounted on a drill pipe, the concave band 64 tends to straighten as shown in FIG. 5B. The decrease in concavity of the metal band is slightly exagerated in the drawings for illustration, however, it can be seen that as the band 64 straightens, the band traps the inner volume 66 and compresses it. The applied tension is sufficient to cause the inner volume of elastomer to flow and provide a fluid tight, hydraulic seal between the invention protector and the drill pipe.

To position the drill pipe protector on the drill pipe, the protector is opened at the split 40 to admit the drill pipe and positioned on the drill pipe. The drill pipe protector is usually formed with recesses 58 and 60 or other indentations on its outside surface which will receive the jaws of a tensioning device. To mount the drill pipe protector, the jaws of the tensioning device are closed upon recesses 58 and 60 causing opposing sides 54 and 56 of the band 16 to draw together and grasp the drill pipe by compressing the inner volume 42 of the elastomeric body between the pipe and the band. The sealing bead 36 is also compressed. Preferably the inner volume of the elastomeric body is formed of an elastomer which, under compression, flows or conforms to the surface of the drill pipe. In this manner there is hydraulic-like engagement of the drill pipe by the protector. While the tensioning means are still closed upon the recesses in the protector, locking pin 21 is inserted into receiving channel 50 in the bands to lock the band 16 under tension on the drill pipe. There will be slight variations in the diameter of band 16 and the width of receiving channel 50 when the band is tension mounted on the drill pipe due to variations in the degree of compression of the inner volume 15 of elastomer and variations in the drill pipe diameter and surface condition. If locking pin 21 is appropriately outwardly tapered it will compensate for any variances in the diameter and latch the protector onto the pipe in a fluid tight attachment. By sliding a distance along the surfaces in tapered receiving channel 50, the pin will fixedly engage the sides of receiving channel 50 and hold the tension in the band imparted by the tensioning means.

Having described my invention in detail and by reference to specific embodiments thereof, it will be apparent to those skilled in the art that numerous variations and modifications are possible without departing from the invention as defined by the following claims.

What is claimed is:

1. A drill pipe protector adapted to be mounted on a generally vertical drill pipe for rotation therewith comprising:

a cylindrical body of an elastomer, said body having inside and outside surfaces and having a split formed longitudinally therein;

an inwardly curved and longitudinally split cylindrical metal band encased in said elastomeric body, said band having an inside diameter greater than the inside diameter of said elastomeric body and dividing said body into inner and outer volumes such that when said protector is tension mounted on a drill pipe, said band captures and compresses a convex inner volume of said elastomer between said band and said drill pipe;

connector means formed on said band at said split;

a sealing bead continuously formed along the periphery of the inside surface of said elastomeric body and along each side of said longitudinal split therein, said bead providing a fluid tight engagement between said protector and said drill pipe; and a locking pin engaging said connector means and adapted to positively lock said protector in fluid tight compressive engagement with said drill pipe.

2. The drill pipe protector of claim 1 wherein said outside surface of said elastomeric body carries a plurality of circumferentially spaced longitudinally extending flutes as radially outwardly extending portions of said elastomeric body.

3. The drill pipe protector of claim 2 wherein the corners of said flutes are radiused to prevent chunking.

4. The drill pipe protector of claim 1 wherein said locking pin is tapered to apply compressional force to said inner volume of said elastomeric body.

5. The drill pipe protector of claim 4 wherein said band is longitudinally positioned in said elastomeric body within an area bounded by said sealing bead.

6. The drill pipe protector of claim 4 wherein said band has openings therein which bind said elastomeric body about said band in a unitary structure.

7. The drill pipe protector of claim 6 wherein said outer volume of said elastomeric body comprises a strong, abrasion-resistant elastomer and said inner volume comprises a softer more pliable elastomer.

8. The drill pipe protector of claim 1 wherein the inside surface of said elastomeric body defines a plurality of grooves.

9. A drill pipe protector adapted to be mounted on a generally vertical drill pipe for rotation therewith comprising:

a cylindrical body of an elastomer, said body having inside and outside surfaces and a longitudinal split formed therein, said outside surface carrying a plurality of circumferentially spaced longitudinally extending flutes, and said inside surface having a plurality of longitudinally extending grooves formed therein;

an inwardly curved and longitudinally split cylindrical metal band encased in said elastomeric body, said band having an inside diameter greater than the inside diameter of said body and dividing said body into an inner convex volume and an outer volume such that when said protector is tension mounted on a drill pipe, said band captures and compresses said inner convex volume of said elastomer between said band and said drill pipe;

connector means formed in said band at said split for receiving a locking pin;

a sealing bead continuously formed around the periphery of said inside surface of said elastomeric body and along each side of said split formed therein, said bead providing a fluid tight engagement between said protector and said drill pipe; and a locking pin which, in cooperation with said connector means, draws said band into a compressional relationship with said inner convex volume and positively locks said protector in fluid tight compressive engagement with said drill pipe.

10. The drill pipe protector of claim 9 wherein said band is longitudinally positioned in said elastomeric body within an area bounded by said sealing bead.

11. The drill pipe protector of claim 10 wherein said band has openings formed therein whereby said band is bound to said elastomeric body to form a unitary structure.

12. The drill pipe protector of claim 11 wherein said outer volume of said elastomeric body comprises a strong, abrasion-resistant elastomer and said inner volume comprises a softer more pliable elastomer.

* * * * *